US006145630A

United States Patent [19]

Friedman et al.

[11] Patent Number: 6,145,630

[45] Date of Patent: Nov. 14, 2000

[54] SLIDING ELEVATOR-DOOR ASSEMBLY AND METHOD OF INSTALLATION

[76] Inventors: Harold S. Friedman, 15 Poplar Dr., Roslyn, N.Y. 11576; Steven Carosella, 129 Soundvin Ave., White Plains, N.Y. 10606; Richard Michalik, 100 Manhattan Ave., Apt. 716, Union City, N.J. 07087

[21] Appl. No.: 09/182,327

[22] Filed: Oct. 29, 1998

Related U.S. Application Data

[63] Continuation-in-part of application No. 08/869,635, Jun. 5, 1997, abandoned, which is a continuation-in-part of application No. 08/591,358, Jan. 25, 1996, Pat. No. 5,673,770.

[51] Int. Cl.[7] ..... B66B 13/06

[52] U.S. Cl. ..... 187/313; 187/325; 49/380; 49/409

[58] Field of Search ..... 187/313, 324, 187/325, 333, 334, 401, 414; 49/380, 409; 52/210, 213, 30

[56] References Cited

U.S. PATENT DOCUMENTS

| | | | |
|---|---|---|---|
| 3,535,837 | 10/1970 | Atkinson et al. | 187/313 X |
| 4,530,189 | 7/1985 | Randall | 187/313 X |
| 4,735,293 | 4/1988 | Everhart et al. | 187/325 X |
| 4,742,645 | 5/1988 | Johnston | 49/380 |
| 5,445,244 | 8/1995 | Ketonen | 187/325 |

OTHER PUBLICATIONS

Tyler Company, "Elevator Cars, Elevator Entrances," (Cleveland 1927), pp. 10, 11, 18, 19.

National Elevator Cab & Door Corp., "'Secure Slide' The Accessible Elevator Entrance," (Mar. 25, 1996).

*Primary Examiner*—Robert P. Olszewski
*Assistant Examiner*—Thuy V. Tran

[57] ABSTRACT

This invention relates to an improved sliding entrance door assembly for an elevator and to the method of installing the assembly. In one embodiment, the elevator sliding entrance door assembly comprises, viewed from the hallway, a sill, a left vertical post having a top portion, a right vertical post having a top portion and positioned parallel to the left post, a header formed with an open notch connected to the left and right posts, a door frame consisting of a strike jamb, head jamb and return jamb attached to the header, one post and sill. An elevator door track is attached to the header. The assembly also includes a sliding elevator door having rolling means to rollingly suspend the door from the track, the door being adjustable after being suspended through the opening formed in the header. In addition, the slide sill having a groove therein which defines a lower track for the door extends between the left post and the right post.

12 Claims, 10 Drawing Sheets

SLIDING ELEVATOR-DOOR ASSEMBLY AND METHOD OF INSTALLATION

RELATED APPLICATIONS

This application is a continuation-in-part application and partly discloses and claims subject matter disclosed in my earlier filed pending application U.S. Ser. No. 08/869,635, filed Jun. 5, 1997 now abandoned, entitled "Elevator Entrance Door Assembly and Method of Installation" which in turn is a continuation-in-part of my earlier filed application U.S. Ser. No. 08/591,358, filed Jan. 25, 1996, now U.S. Pat. No. 5,673,770, entitled "Sliding Door Assembly For An Elevator and Method of Installing Same," the disclosure of each of which is incorporated herein by reference.

FIELD OF THE INVENTION

The present invention relates to new building construction and more particularly to a sliding entrance door assembly for an elevator which may be installed and adjusted quickly and easily.

BACKGROUND OF THE INVENTION

Two types of elevator entrance assemblies that are commonly used to provide access to elevators are swing entrance assemblies and sliding entrance assemblies. Swing entrance doors open by pivoting about a hinge when the door handle is pulled. Sliding entrance doors open by traveling along a linear track in tandem with an elevator cab door. This invention relates to an improved sliding door assembly, especially in constructing new buildings.

An elevator door entrance assembly refers to the frame and sliding door which separates a hallway (corridor) from the elevator shaft (hoist way or shaftway). As the door on the elevator cab opens, or closes, it drives the entrance door open or closed. In the past, the construction of a sliding door for elevators has been relatively labor intensive, time-consuming, expensive and has presented significant safety hazards.

A traditional problem associated with the installation of new elevator systems in new buildings is that the entrance door installation has been almost the last step in the overall system installation procedure. This results in a long period during construction wherein there is an unfinished gap between the hallway and the elevator shaftways. If tools, loose bolts, etc. should fall down the elevator shaft, they may injure those below. This unfinished gap is typically covered with a temporary barrier such as plywood or wooden barricades. Frequently during the course of construction, these barriers are removed and not replaced, or replaced carelessly.

In addition, the door, and possibly parts of the frame and other components of the entry assembly have been generally lifted and installed from the elevator platform or temporary work platform after sufficient work has been performed by the elevator constructors and electrical power put in-place to allow the platform to move in the shaftway. This sequence is a result of the entrance design and installation method which requires that the frame be installed and aligned prior to hanging the door. This procedure requires that the elevator platform (work platform) be lifted and lowered in the elevator shaft as a requirement of entrance assembly installation. This procedure makes the moving elevator platform and elevator shaft unavailable for other work. For example, if it requires one-half of a day to install the frame, door, etc. of each entrance assembly of an elevator shaft and the building is 20 floors high, the moving platform must be used for 10 work days for installation of entrance assemblies on that shaftway. Often the moving platform must be operated by a special, and costly, operator and is required for other construction tasks, which must wait until the moving platform is no longer needed for the installation of entrance door assemblies.

SUMMARY OF THE INVENTION

In accordance with the principles of the present invention, the shortcomings of the aforementioned construction method and system have been overcome through a new and improved sliding entry door assembly and installation process. The elevator sliding entrance door assembly is installed between a hallway and an elevator shaft. The assembly is installable into a rough opening in a wall located between the hallway and the shaft and having a front face forming a plane and a rear face forming a different plane. In one embodiment, the sliding entry door assembly includes a slide sill having a groove therein which defines a lower track for a sliding elevator door, a header supported by a plurality of support members, and an elevator door track attached to the header. The assembly also includes a frame comprising a strike jamb or post having a top portion, a return jamb or post positioned parallel to the strike jamb, and a head jamb connected to the strike and return jambs posts proximate their top portions. The frame is installed only after suspending a sliding elevator door from the track, which facilitates the hanging of the door. The strike jamb of the frame and one of the support members form a composite strike pocket for the elevator door.

In another embodiment of the present invention a sliding entry door assembly includes a slide sill having a groove therein which defines a lower track for a sliding elevator door, a header supported by a plurality of support members, an elevator door track attached to the header, and one or more stationary panels attached to the header, support members and building structure. The assembly also includes a frame comprising a strike jamb or post having a top portion, a return jamb or post positioned parallel to the strike jamb, and a head jamb connected to the strike and return jambs posts proximate their top portions. The frame is installed after suspending a sliding elevator door from the track, which facilitates the hanging of the door. The strike jamb of the frame and one of the support members form a composite strike pocket for the elevator door. The stationary panels may comprise a side panel and a transom panel. The side panel replaces the wall adjacent to the elevator opening. The transom panel is located above the sliding entry door and the side panel. In its open position, the sliding entry door is positioned, behind the stationary side panel. By using the stationary panel, which is thinner than a conventional wall having the same fire rating, the sliding entry door assembly uses less of the hallway space.

In another embodiment, two or more sliding hoist way doors are installed in the frame. They are in separate planes so that the doors can slide in the same direction behind one another. Each of the sliding hoist way doors slides at a uniquely defined speed so that each of the sliding entrance doors complete their slide approximately simultaneously. This embodiment may use a stationary panel configuration.

Another embodiment is of a center opening sliding entry door assembly which includes left and right sliding doors in the same plane which open from the center to the left and right, respectively. This embodiment may use a left, and a right, stationary panel configuration.

A superior elevator entry door assembly may be constructed according to the present invention with minimum noise, dirt, disruption, and delay as well as with greater safety. A main advantage is that the entire assembly, including hanging the door (or doors), may be performed from the hallway. No use need be made of a moving elevator platform. This arrangement permits the elevator platform to be used for other purposes and saves the labor cost of its operation. Alternatively, it permits the installation of entrance assemblies in the phasing of work at the jobsite prior to the advent of an elevator platform capable of moving in the shaftway.

Another advantage is that the entry door assembly may be installed in a building in less time than conventional elevator entry door assemblies. It is possible to install this new elevator entry door assembly in a single day.

Another advantage is that the new door assembly, when used in its stationary panel configuration, requires less space than conventional elevator entrance door assemblies. It allows the construction of a thinner front elevator shaftway wall thereby resulting in an increase in usable building space.

Another advantage is that the assembly, when used in its stationary panel configuration, closes the gap to the shaftway as soon as it is installed, without a temporary barrier, such as a plywood sheet barrier. In addition, that closure, consisting of the door (or doors) and stationary panel (or panels) has a fireproof rating. That closure of the opening to the shaftway is an important safety feature as it prevents persons and objects from accidentally falling down the shaftway.

The elevator entrance door assembly may be installed either in a new building ("new construction") or as a replacement of an existing entry door ("modernization"). It has a frame having (as viewed from the hallway) a left post, a right post and a top header connecting the left post to the right post. The entry door assemblies, which do not open from the center, may also have a center post. A transom panel may be located on the top portion of the entrance frame and fixed to the top side. A stationary side panel may be located on one side of the entrance frame and affixed to the adjacent post and the sill and the transom. The transom and the vertical posts (left, right and center) may be exposed to the hallway. A sliding elevator entrance door slides within the elevator entrance frame. In its open position, the sliding elevator entrance door slides behind the stationary panel.

This assembly requires about two to four fewer inches in space (thickness) than conventional elevator door assemblies. Thus, in buildings that have elevators on both sides of a hall, a total of about four to eight inches may be saved on each floor.

Additionally, this elevator entry door assembly is safer to install and provides a safe elevator shaft during construction of a building. It can be installed in a building without leaving the shaft open for an extended period of time. Open shafts pose a great danger because people can fall down the shaftway or objects can fall down the shaft and a strike a worker.

To reduce the danger posed by open shafts, conventional elevator door assemblies require the erection of temporary barricades, such as a sheet of plywood. These barricades take time to erect, are aesthetically undesirable in modernization and, through carelessness, may be omitted. These partitions are also not fire rated.

The entry door and stationary panel assembly of the present invention completely closes the shaft and provides a fire rating as soon as it is installed. The elevator entrance assembly also provides a savings of indirect costs because of reduced field costs, i.e., there is no use made of the moving elevator platform for installation; the assembly is quicker to install; the sequence of trades, i.e., carpenters, electrical workers, etc. is simplified so that it is less costly.

DETAILED DESCRIPTION OF THE INVENTION

The elevator sliding door assembly of the present invention is built into the wall forming the elevator door opening. Specifically, the frame assembly fits into the wall and the struts, for example, the posts, and the header fit behind the wall. Preferably the entire assembly is sufficiently thin (for example, 8–12 inches or less) to fit within conventional cement block walls, or masonry walls which are 6–12 inches thick or dry wall construction, which is generally 3¾ to 5½ inches thick.

The assembly may be based on a frame whose parts are pre-cut so that they may be assembled, on site, preferably using nuts and bolts. Alternatively, the entire frame (without the door or other parts) may be assembled in a factory, for example, by welding, and transported and erected at the site as a unit. When using welded frame construction, the door frame comprising a left post or strike jamb, right post or return jamb and header are welded as a unitary construction, with the other parts assembled on site and installed before installing the door frame. In each case, the entire assembly, including the door and other parts, is installed from the hallway (corridor) and not from the elevator shaft (hoistway or shaftway). This arrangement presents the advantage that installation of the door does not occupy time from a moving platform (elevator) which may be used on other projects. A moving platform is the work elevator which is lifted and lowered in the elevator shaft during construction. In addition, the hallway presents a base which is stable and readily accessible.

The first embodiment is of a single door hoistway door assembly. Its frame includes, viewed from the hallway as in FIG. 1, a left post 10 (forming the left boundary of the frame), a return post 11, which is optional, and a right post 12 (forming a right boundary of the frame). The left post 10 is the strike jamb of the elevator entrance; the right post 12 is its support strut, and the center post is its return jamb. The center post is attached to the transom 20 and is optional (may be omitted in certain product configurations).

Figure 4:
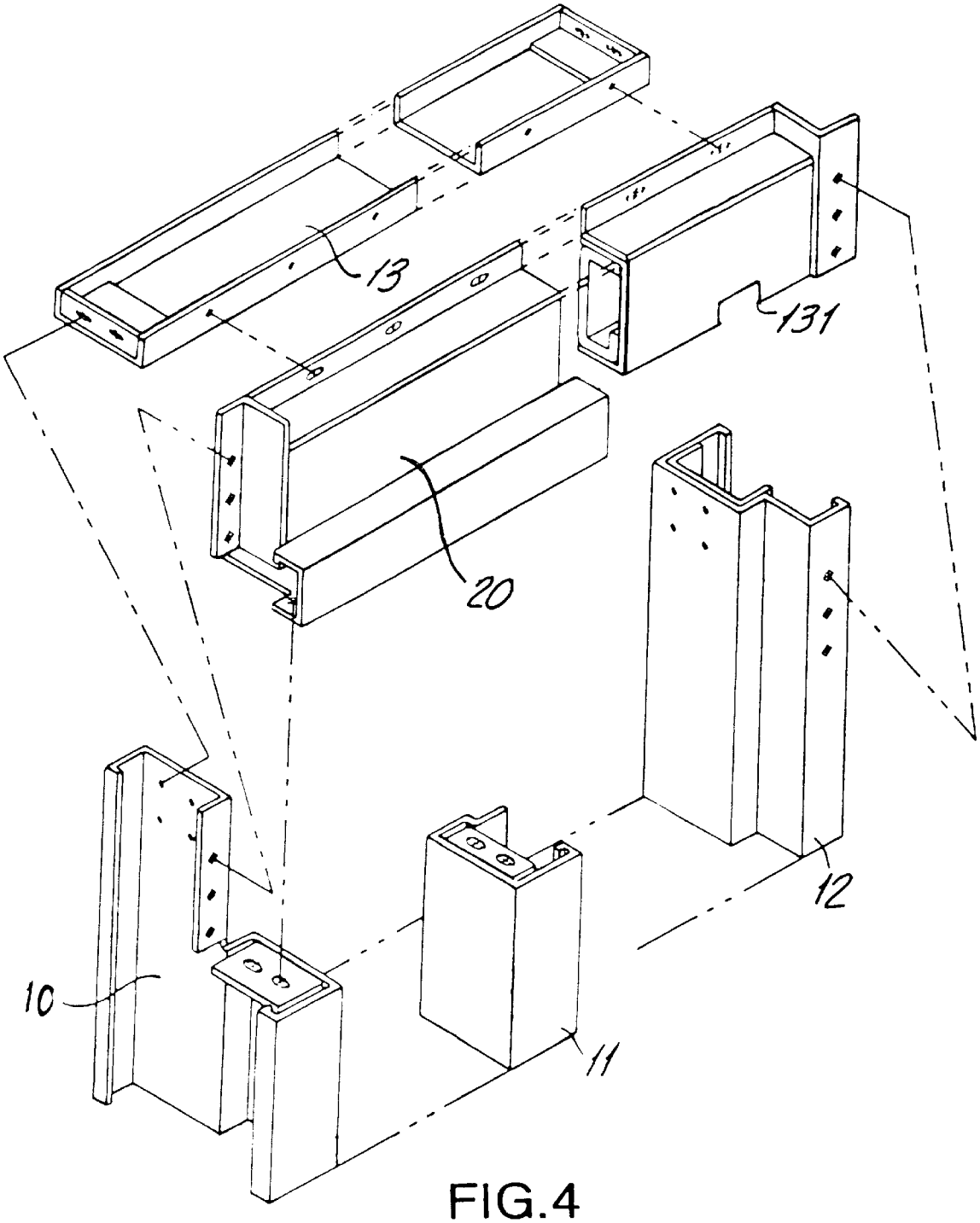
FIGS. 4 and 5 are perspective views of frame members of the assembly of FIG. 1, note that FIG. 5 includes stationary panels.

A transverse channel 13 is attached to the left post 10 and right post 12 at their top portions, see FIG. 4. Preferably the posts 10–12, as well as transverse channel 13 and other frame members, are formed of No. 12 USSG Cold Rolled Furniture Steel. They are formed in a general "U" shape (in cross-section). The posts 10, 11 and 12 are vertical and parallel; the transverse channel 13 is horizontal and spans the posts 10, 11 and 12.

Figure 14:
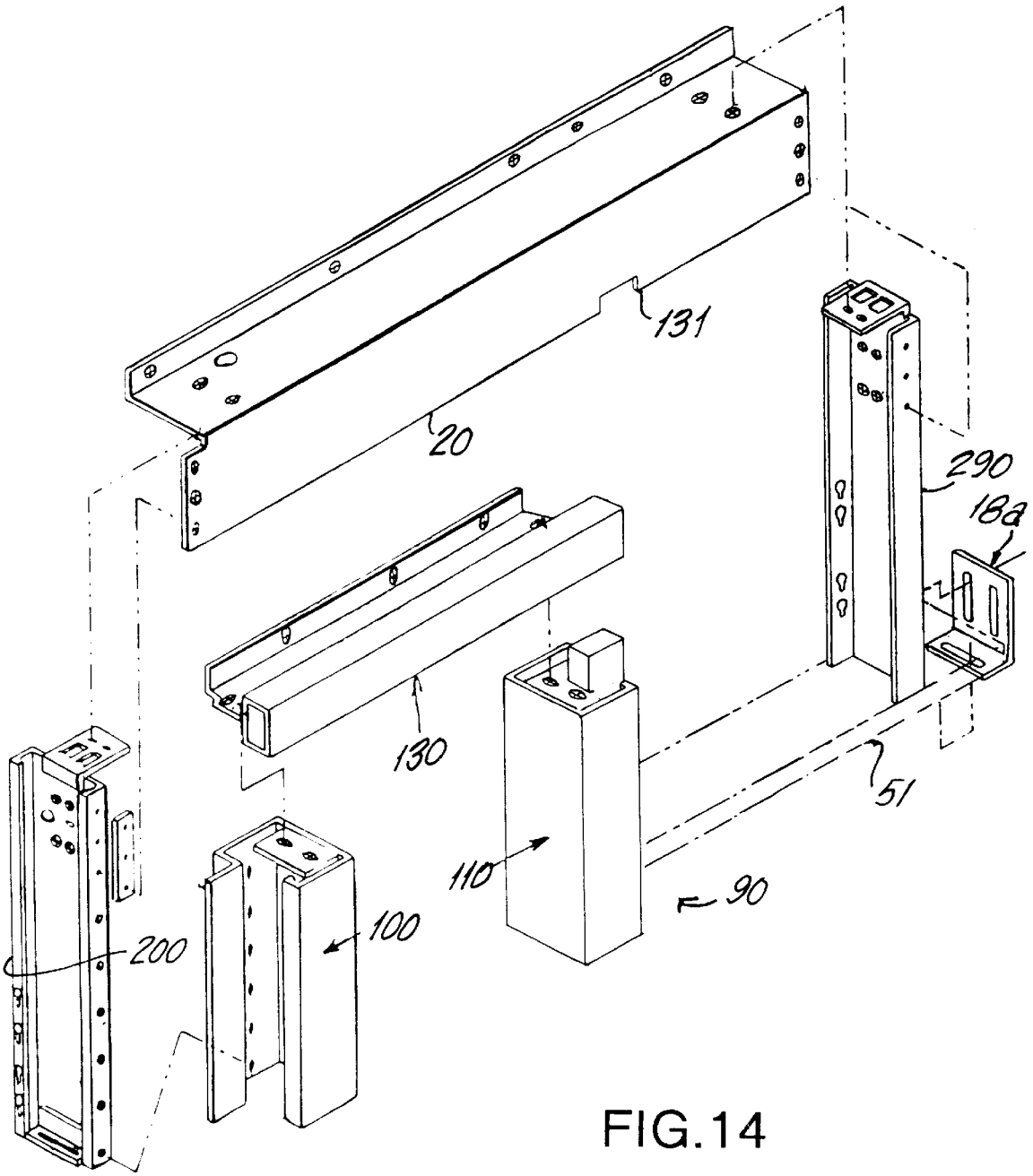
FIGS. 14 and 15 are perspective views of an embodiment of the sliding entrance door assembly of the present invention.
Figures 15, 16:
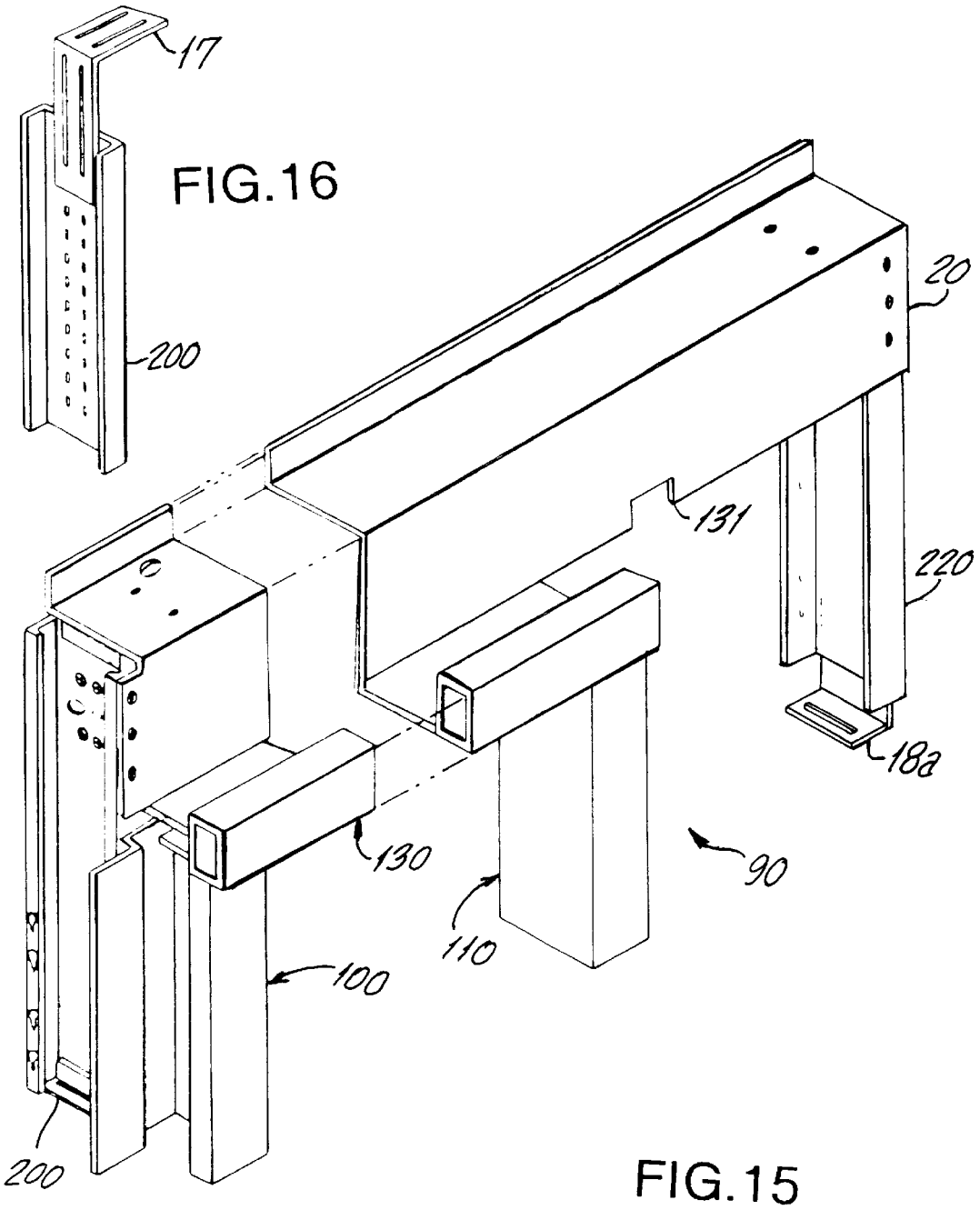
FIG. 16 is a perspective view of the upright channel and strut extension of the embodiment of FIGS. 14 and 15.

Another embodiment is that the frame be formed, e.g., by welding, as a unitary structure 90 comprising a strike jamb 100, a return jamb 110, and a head-jamb 130, see FIG. 14. The header 20 is attached to upright channels or support members 200, 220 and installed prior to installing the door frame 90, the door thereby may be suspended without interference from the frame. The header 20 has an opening or notch 131 formed within it to permit adjusting from the hallway of the door after it is hung. The strike pocket is formed by bolting support member 200 to strike jamb 100.

Figure 2:
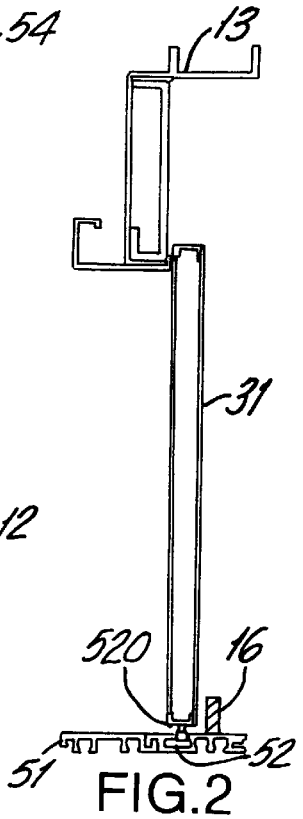
FIG. 2 is a side cross-sectional view of the sliding entrance door assembly of FIG. 1.
Figure 3:
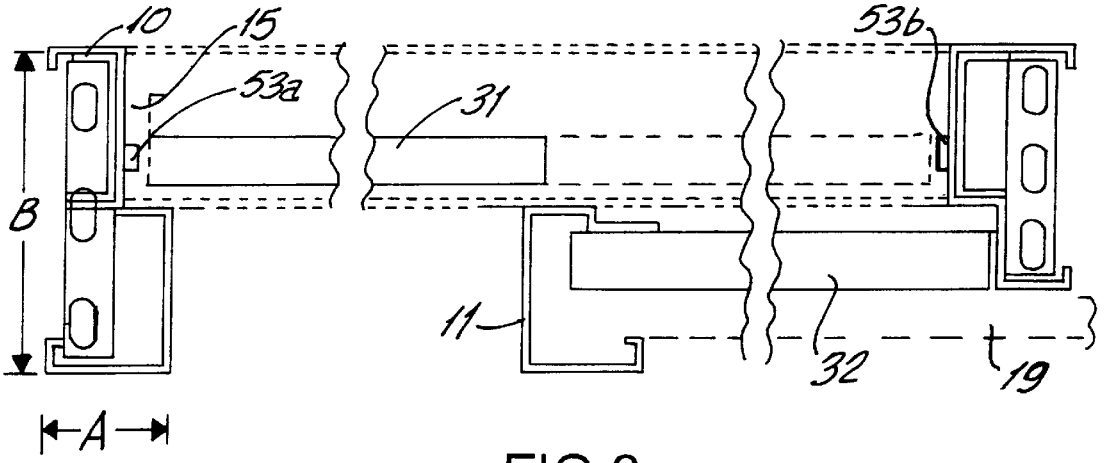
FIG. 3 is a top view of the sliding entrance door assembly of FIG. 1.

As shown in FIG. 3, the left post is preferably 2 inches (5.08 cm) wide—front arrow A; and 8⅛ inches (20.63 cm) thick—arrow B. Post 10 has an indented portion 15 to receive the sliding door. The posts 10–12 would typically be about 84 inches (213.36 cm) in height, although their height depends on the height of the sliding door. Mounted to the frame 9 (door buck) are a left door bumper 53A and a right door bumper 53B to absorb the impact of the sliding entrance door 31. A left door stop 16 and right door stop (not shown) are mounted to the slide sill 51 (saddle) to prevent the sliding entrance door 31 from being pushed into the elevator car, as shown in FIG. 2. When the assembly has been completed, the slide sill 51 will have been positioned on the floor between the left post 10 and right post 12 of the elevator frame 9. Slide sill 51 is installed in the hallway proximate the elevator shaft and the frame 9 installed thereafter. The slide sill 51 has a groove which defines a lower track 52 for the sliding entrance door. In one embodiment, the stationary panel 32, may be covered with a conventional dry wall (sheet rock-plaster board) 19, tile, or other decorative covering.

Figure 5:
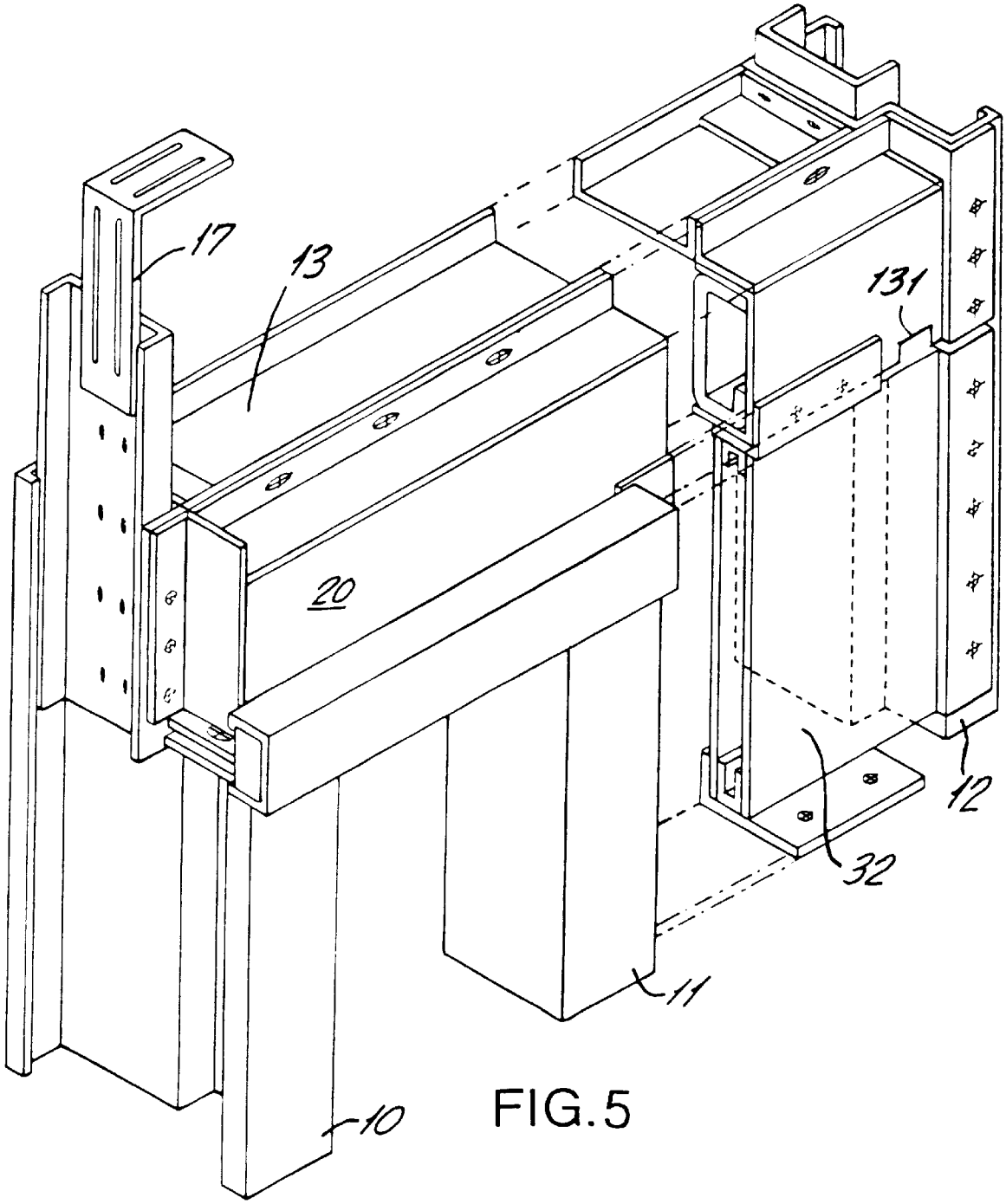

As shown in FIG. 5, which is a view from the front (the hallway) a header 20 may be bolted to the right post 12 (rear jamb), to the center post 11 (return jamb), and to the left post 10 (strike jamb), and to the transverse channel 13. An adjustable bracket or strut extension 17 connects the left post 10 to a cross-beam of the building and a similar adjustable bracket 18 (not shown) connects the right post 12 to the beam. Similar mounting brackets 17*a* (not shown) and 18*a* connect the right post 12 or upright channel 220 (see FIG. 14) to the slide sill or saddle 51.

Figure 6:
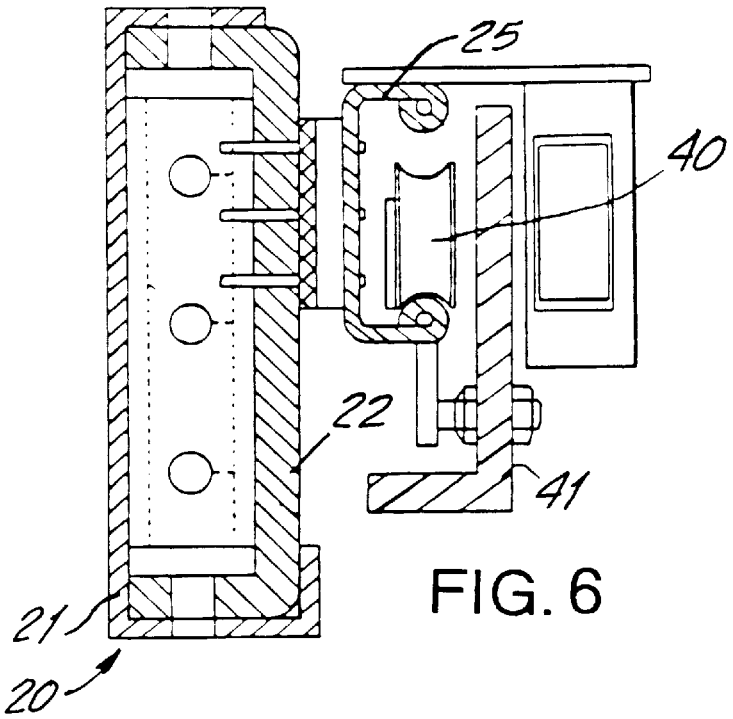
FIG. 6 is a cross-sectional view of the transom and track of the assembly of FIG. 1.

As shown in FIG. 6, the header 20 consists of a front panel 21, preferably 7.5 inches (19.05 cm) high, and a back panel 22, preferably 7⅝ inches (19.37 cm) high, which fits in the front panel. The front panel 21 is preferably of 16-gauge cold rolled steel and the back panel 22 is preferably of 3/16 inches (0.48 cm) steel. The back panel is of a heavier gauge metal as it supports the track 25. FIG. 6 shows a roller 40 which is attached to the hanger 41 which is bolted to the top of the door 31. The roller 40 rolls on the track 25. Generally the door 31 is suspended by two hangers, each rotatably carrying a roller.

Figure 1:
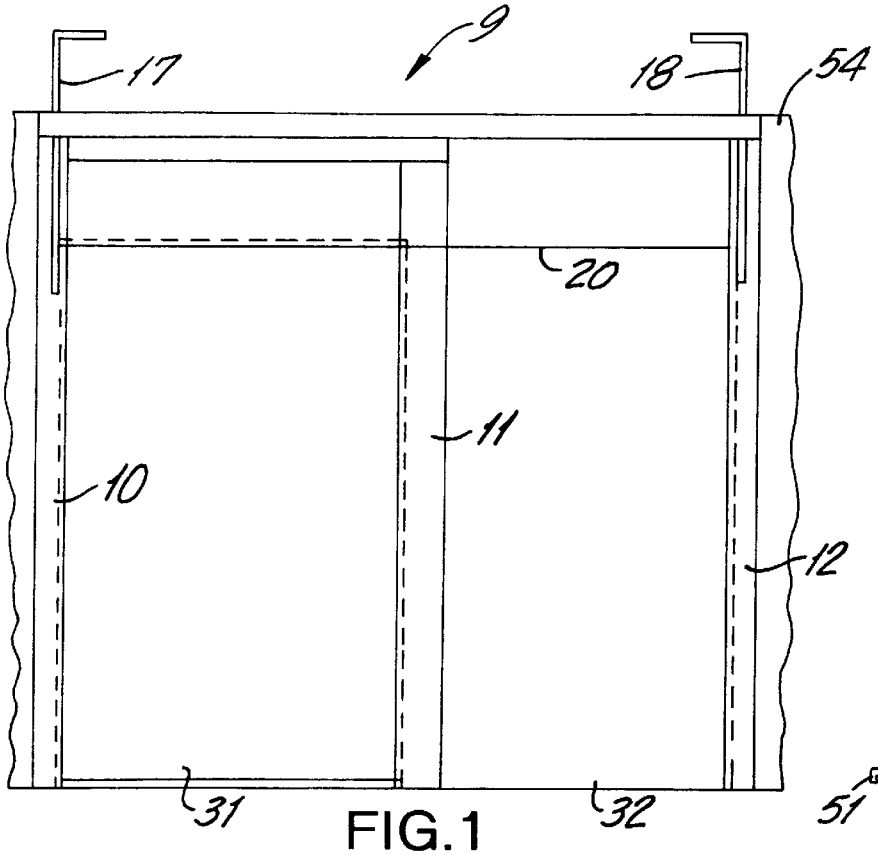
FIG. 1 is a front view of a sliding entrance door assembly of the present invention.

As shown in FIG. 1, a stationary side panel 32 may be connected to return post 11 and right post 12 and span the space between them. That stationary panel, along with the door, closes the shaft during construction. There is a danger, if the elevator shaft is left open during construction, that loose bolts, tool and debris may fall into the shaft and injure workers below.

Figure 12:
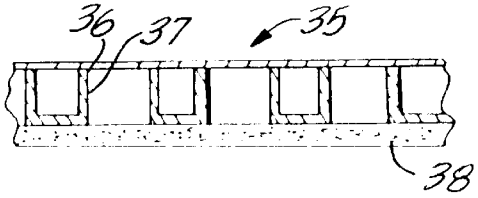
FIGS. 12 and 13 are top cross-sectional views of sections of alternate stationary panels.
Figure 13:
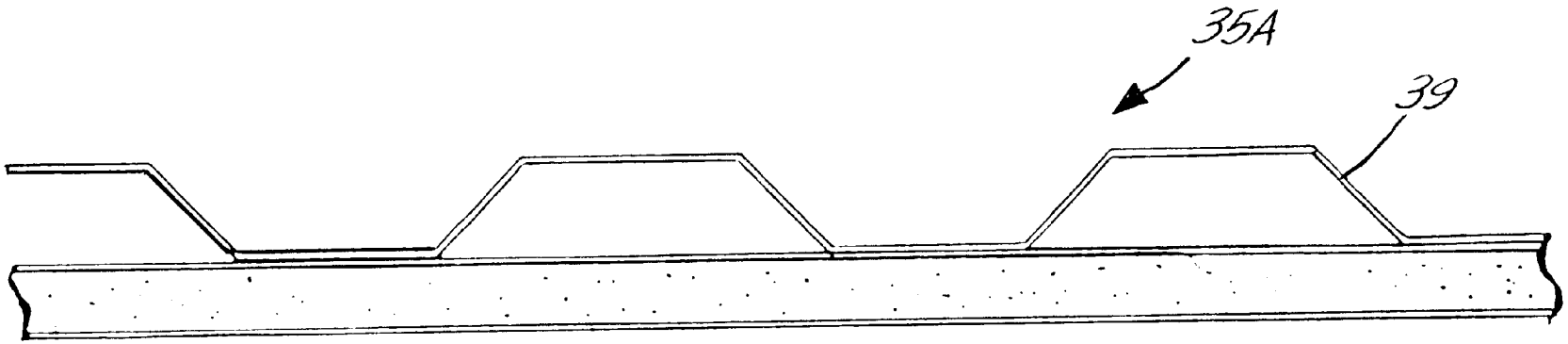

The stationary panel is fire-rated which means it passes a fire test administered by Underwriter's Laboratories (UL). It is preferably sufficiently strong to withstand 1000 pounds per square foot pressure. A suitable stationary panel is 1⅜ inches or thicker and has front and rear faces of No. 16 or 18 USSG Cold Rolled Furniture Steel, respectively, and internal beam reinforcements. Alternatively, a lighter weight stationary panel may use a cardboard based honeycomb core and steel inner and outer faces. Two alternative side panels 35 are shown in FIGS. 12 and 13. The side panel 35 consists of a back sheet 36 of sheet metal, vertical metal hats 37 and a front face of a conventional sheet rock 38, see FIG. 12. The side panel 35A is a corrugated sheet-metal panel 39 which in effect, has parallel vertical studs, see FIG. 13. The panels 35 and 35A have a front face of dry wall (sheet rock). For example, the studs 37 may be thin, 1–2 inches, in order to provide a thin panel. The dry wall sheet 38 may be one or more sheets in order to provide, along with the studs, a two-hour fire rating. In the embodiment of FIG. 12, the metal sheet 36 is supplied by the factory with the studs 37 welded thereto. The sheet rock is attached to the studs or corrugated sheet, on site. The sliding door 31, in this embodiment, has a fire rating 1–1½ hours and has front and rear faces of No. 16 or 18 USSG Cold Rolled Furniture Steel with internal vertical steel reinforcement beams. It is 1¼ inches thick or thicker. The door 31 and stationary panel 32 may be painted and may be decorated.

The size of the siding entry door 31 is slightly larger than the opening defined by the header 20, stationary side panel 32, sill 51 and left post 10 to substantially seal the opening.

As shown in FIG. 6, an upper track 25 is mounted on the header 20 and hangers 41 are mounted on the top of the sliding entrance d or 31, enabling the sliding entrance door 31 to travel smoothly in a linear path. Gibs 520 are affixed to the bottom of the sliding door 31 for guiding the sliding door in the groove 52 of the slide sill 51, as shown in FIG. 2.

An interlock is mounted on the header 20. The interlock prevents the sliding entrance door 31 from opening when it is not positioned adjacent to the elevator car.

The entire erection of the elevator door assembly is preferably accomplished from the hallway (corridor). In new construction the hallway would be a raw (unfinished) concrete slab floor and walls. Typically, the erection of an elevator door assembly required the use within the elevator shaft of a moving elevator platform, thereby posing a difficult scheduling problem. For example, if a building is 20 floors high, and it take ½ a day to erect each elevator door assembly, then a moving platform (work elevator) and shaft (hoist way) would be used for the elevator entrance assembly construction for 10 days. The moving platform (work elevator) cannot be used, during that time, for other purposes.

The vertical posts 10, 11 and 12, horizontal transverse channel 13, header 20 and track 25 may readily be lifted to the job site and installed using bolts and nuts. Preferably, a unitary frame comprising strike jamb 100, return jamb 110 and head jamb 130 is constructed, for example by welding, and installed after the header 20 and track 25 are installed and door 31 is hung. Also the stationary side panel 32 may readily be bolted onto the frame members after they are assembled.

The elevator door 31 may seem to present a problem, since it must be hung from the track 25 if the frame is installed before the door is hung. The preferred way to hang the sliding door 31 is as follows. The elevator platform is positioned at the floor above or at some other floor where it is out of the way and available for use if needed. A saddle or slide sill 51 having groove 52 defining a lower track is installed in the hallway proximate the shaft. Then header 20, having had an elevator door track 25 previously attached, supported by upright channels or support members 200, 220 is installed. After positioning temporary safety barriers, the door 31 is prepared with its hangers and rollers installed. The door is placed in the hallway in front of the track 25 and angled into the shaft with its bottom on the hallway floor and its top at an angle extending into the shaft. The door is then brought to the vertical so that its rollers are placed within the track (rollable on the track). The door has been hung when the rollers roll on the track and the door is vertical with the gibs 520 (guides) aligned in sill groove 52. Then the unitary frame 90, see FIG. 14, is installed, for example by bolting to upright channel 200 and transom 20. Final adjustments to plumb and adjust the door 31 from the hallway side are made by accessing roller assembly 40 via notch 131 in header 20.

Alternatively, the frame 9 is erected without center post 11 and after the door is hung, center post 11 is installed.

The following are some additional alternative methods of hanging the door 31 on the track 25 after the frame is installed:

(A) One end of the header is hinged and it is otherwise left unconnected. For example, the header is connected to the left post 10 by a strong hinge and is not connected to the center post 11 or the right post 12. That hinge permits the header to be swung outwardly into the hallway. The door 31 is hung on the header while the header is jutting into the hallway. The header 20 and door 31 is then swung back into place and the header 20 secured to the transverse channel 13, center post 11 and right post 12.

(B) The entire frame is assembled and laid flat on the hallway floor. At that time the door 31 is hung on the track 25. the frame, along with door 31, is pivoted, placed upright and secured in its intended position.

(C) The rollers 40 and the reverse L-shaped hanger member 41 attached to the rollers 40 are hung on the transom 20 after the transom is assembled to the posts 10–13. The entire frame is assembled. Then the door 31 is fastened to the hangers 41.

After the, plumbness of the assembly is inspected and preferably adjusted through opening 131 in header 20, concrete is poured between the elevator frame and the block wall for bonding the elevator frame to the block wall 54.

The description has been of a single sliding elevator door assembly. However, this assembly may be used as a module and combined, preferably at the building site with similar modules, to form pairs of assemblies or entire walls of elevator door assemblies.

Figure 10:
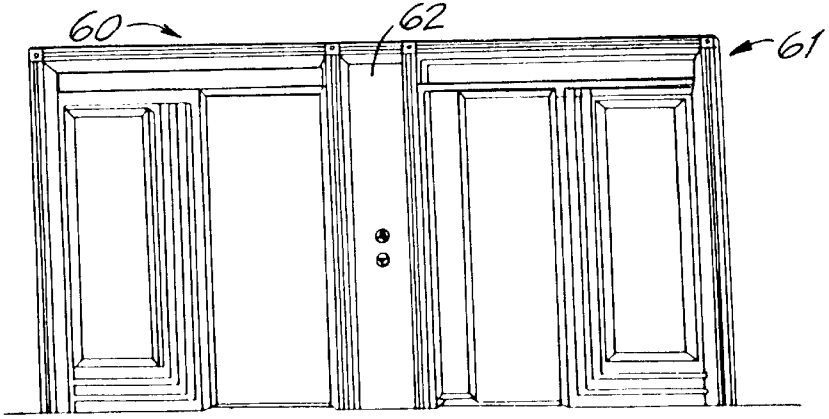
FIG. 10 is a front view of two side-by-side entrance door assemblies.

FIG. 10 shows two elevators sliding door assemblies 60 and 61 each of which is of the same construction as is illustrated in FIGS. 1–6. A panel 62 having buttons (on its front) and electrical controls behind the panel (not shown) is preferably assembled and wired in the factory.

Figure 11:
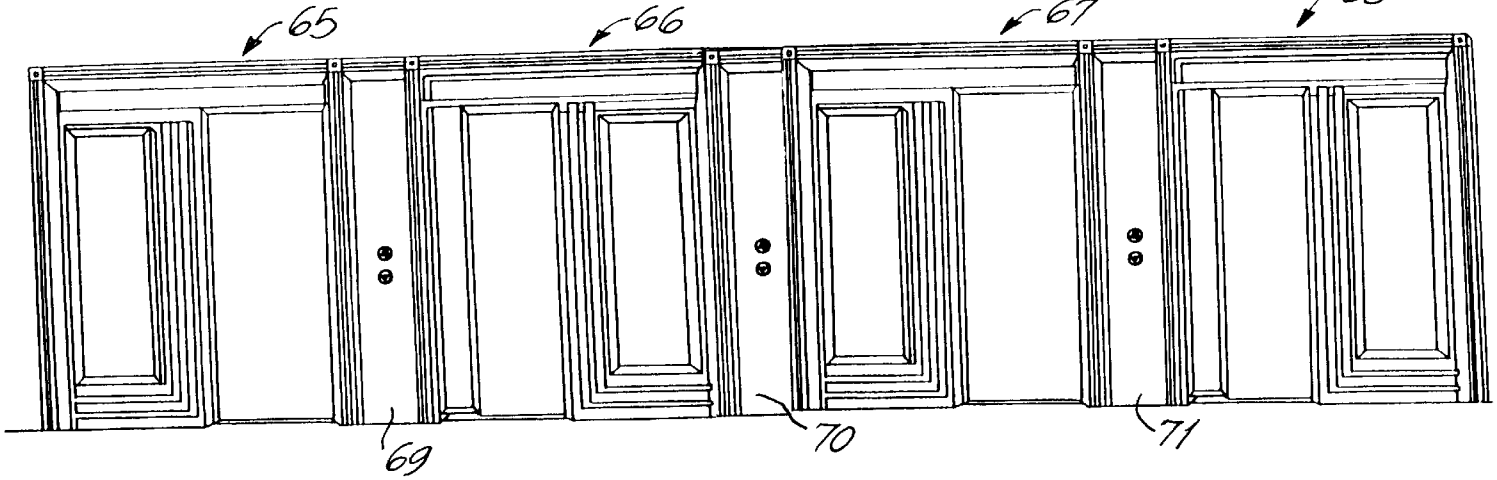
FIG. 11 is a front view of an entire wall comprising four entrance door assemblies.

FIG. 11 shows an entire elevator hall wall formed of four sliding door assemblies 65–68 and panels 69–71. The assemblies are of the type illustrated in FIGS. 1–6 and the panels 69–71 are formed and wired in the factory and then assembled to the frame assemblies on site.

Figure 7:
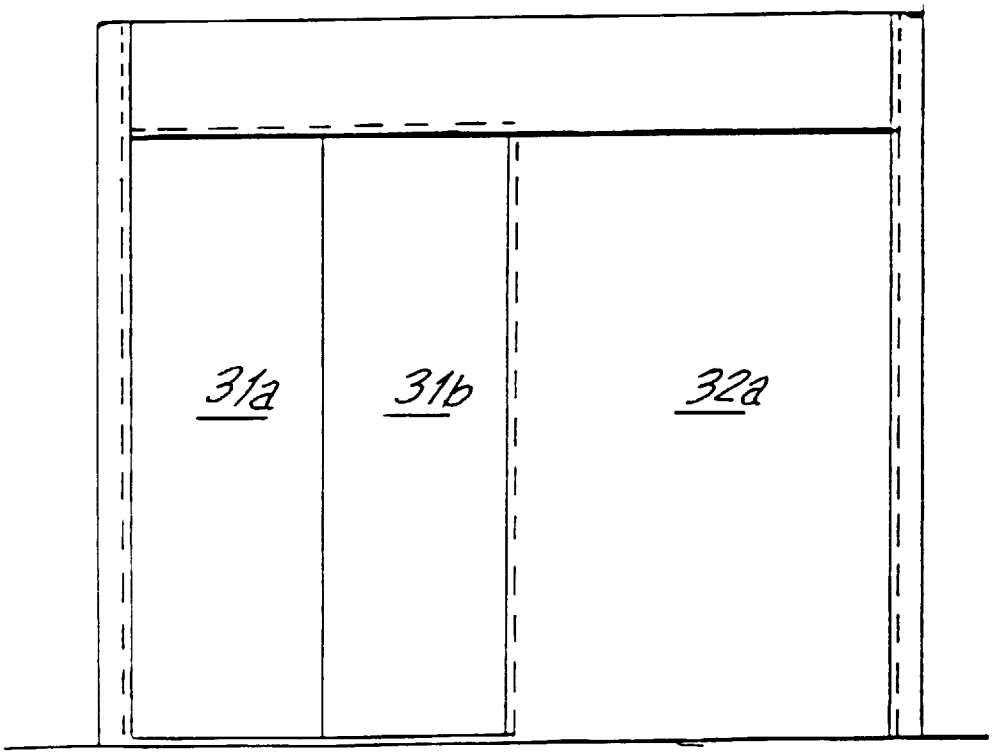
FIG. 7 is a front view of the transom and track of the assembly having two sliding doors.
Figure 8:
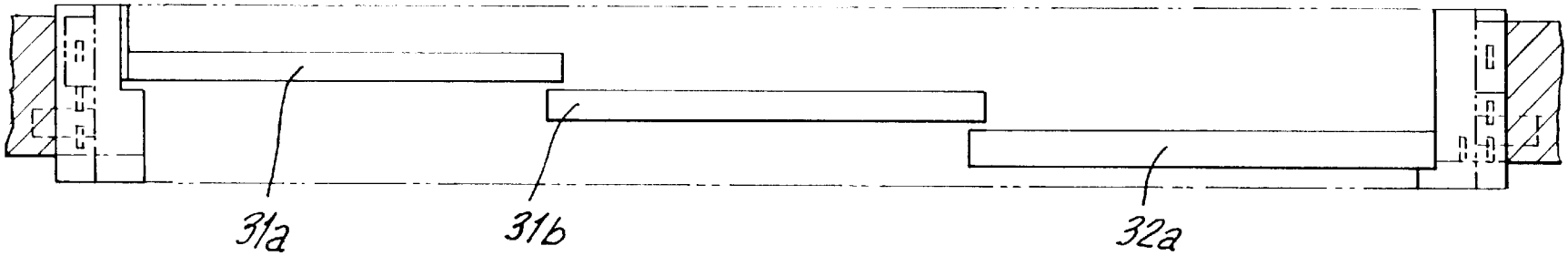
FIG. 8 is a top view of an embodiment of FIG. 7.
Figure 9:
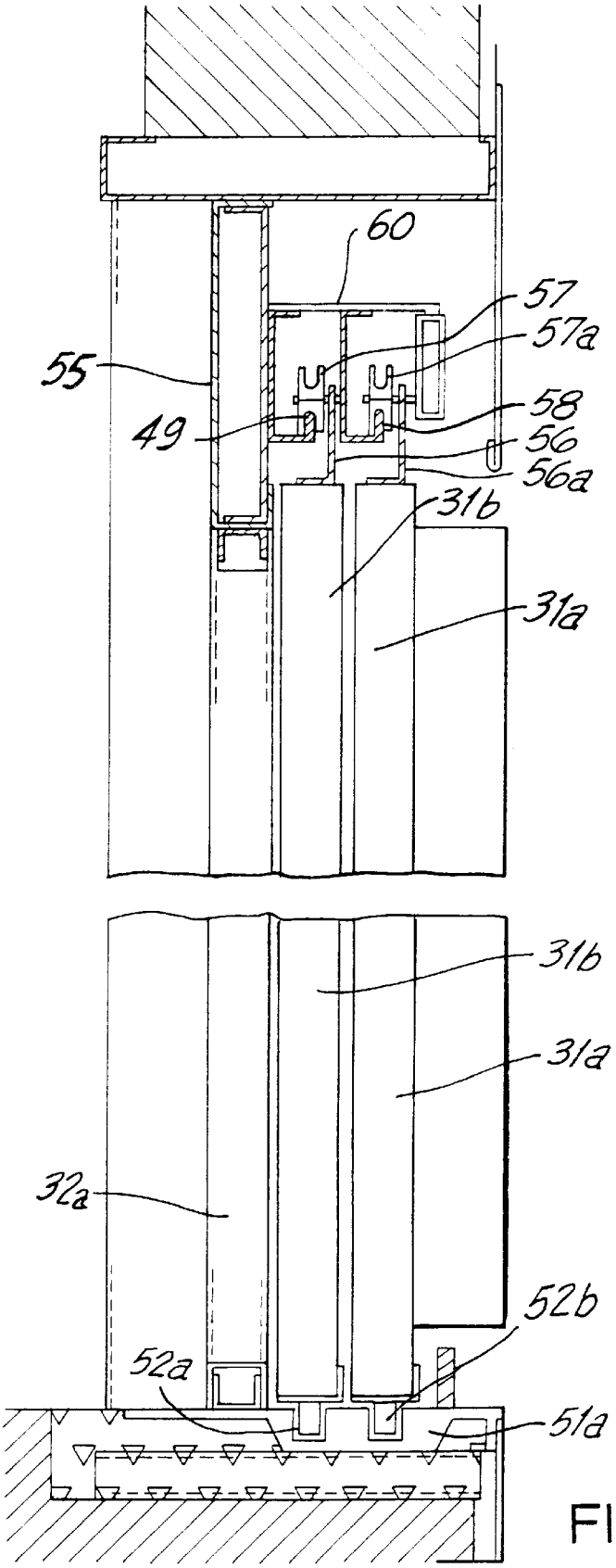
FIG. 9 is a side cross-sectional view of the sliding entrance door assembly having two sliding entrance doors.

FIGS. 7–9 show an alternative embodiment of the present invention, in which two sliding entrance doors are installed in the same frame. The entrance doors are in separate planes so that one of the doors can slide behind the other. One of the sliding entrance doors slides faster than the other so that both sliding entrance doors complete the slide approximately simultaneously behind the side stationary panel. This principle can be expanded to use three (3) sliding doors in the same fashion based on space and door opening size required in a particular installation.

When the elevator entrance doors open, the sliding entrance doors and the side stationary panel 32*a* line up in three separate planes. Since there are two elevator entrance doors in this embodiment, the side stationary panel can be narrower than the one used in the single door embodiment.

In this embodiment a slide sill 51*a* has two grooves that define two lower tracks 52A, 52B for both entrance doors 31*a* and 31*b*. An upper track 49 is mounted on the transom 55. Hanger 56 and roller 57 are mounted on the top of the sliding entrance door 31*b*. The roller 57 rolls on the upper track 49 enabling the sliding entrance door 31*b* to travel smoothly in a linear path. An upper track 58 is mounted to a brace 60 which is attached to the transom 55. Hanger 56a and roller 57*a* are mounted to the top of the left sliding entrance door 31*a*. The roller 57*a* rolls on the upper track 58*a* enabling the sliding entrance door 31*a* to travel smoothly in a linear path. An interlock is mounted on the brace 60. The interlock prevents the sliding entrance door 31*a* and sliding entrance door 31*b* from opening when they are not positioned adjacent to the elevator car.

When the elevator entrance doors open, the sliding entrance door 31*b* slides behind the stationary panel 32*a* and the sliding entrance door 31*a* slides behind the sliding entrance door 31*b*. The sliding entrance door 31*a* slides faster than the sliding entrance door 31*b* so that both doors complete the slide approximately simultaneously.

Alternatively, the present invention may be applied to a center-opening entrance door assembly. In that case the doors open from the center—one to the left and one to the right. Two stationary panels are used, one on the left and one on the right. Two center posts, which are optional, may also be used.

The foregoing description of the invention should be considered as illustrative, and not as limiting. Various changes and modifications will occur to those skilled in the art, without departing from the true scope of the invention as set forth in the following claims.

What is claimed is:

1. An elevator sliding entrance door assembly installed between a hallway and an elevator shaft which provides a passage between the hallway and shaft, said assembly being installable into an opening in a wall, said wall being located between the hallway and the shaft and having a front face forming a plane and a rear face forming a different plane, said assembly comprising, viewed from the hallway:

(a) a left vertical post (b) a right vertical post positioned parallel to the left post;

(c) a head jamb connected to the left and right posts;

(d) a header attached to the head jamb and left post and right post, said header having an opening formed therein;

(e) an elevator door track attached to the header;

(f) a sliding elevator door suspended from the track via a hanger/roller assembly, said door being adjustable after being suspended from the hallway via the opening in the header;

(g) a slide sill having a groove therein which defines a lower track for the door, the sill extending between the left post and the right post.

2. An elevator door assembly according to claim 1 wherein the left vertical post and right vertical post have U-shaped portions in plan view.

3. An elevator door assembly according to claim 1 wherein the rolling assembly includes at least two hangers connected to the door and a roller rotatably mounted on each hanger, so that said sliding door can slide across the door track.

4. An elevator sliding entrance door assembly installed in a building structure between a hallway and an elevator shaft dividing the hallway and shaft, said assembly being installable into a rough opening in a wall, said wall being located between the hallway and the shaft and having a front face forming a plane and a rear face forming a different plane, said assembly comprising, viewed from the hallway:

(a) a header supported by a plurality of support members;

(b) an elevator door track attached to the header;

(c) a sliding elevator door having rolling means to rollingly suspend the door from the track;

(d) a slide sill having a groove therein which defines a lower track for the door; and (e) a frame comprising a strike jamb, a return jamb positioned parallel to the strike jamb, and a head jamb connected to the strike and return jambs proximate their top portions, said strike jamb and one of said support members forming a composite strike pocket for said elevator door.

5. An elevator entrance assembly according to claim 4 wherein said header has an opening formed therein and said door is adjustable after being suspended through said header opening.

6. An elevator entrance assembly according to claim 4 wherein said assembly further comprises a stationary side panel extending from the finished floor to the header and proximate one of said support member and return jamb, said stationary panel being attached to the header and the support member, said panel occupying about one-half or less of the wall opening and being between the front and rear facing planes of the wall.

7. An elevator entrance assembly according to claim 4 wherein said assembly further comprises a stationary transom panel extending from the header to the underside of the building structure above the entrance and proximate said support members and return jamb, said stationary panel being attached to the header and the building structure, said panel occupying about one-half or less of the wall opening and being between the front and rear facing planes of the wall.

8. An elevator door assembly according to claim 6 wherein the assembly is no more than 7 inches thick and said stationary panel is no greater than 1⅜ inches thick.

9. A method of installing an elevator sliding entrance door assembly in a building under construction without using a moving platform, in which the assembly is installed between a hallway and an elevator shaft and which closes off the shaft during construction; the assembly being assembled from the hallway and viewed from the hallway, the steps of the method comprising:

(a) installing a sill in the hallway and proximate the shaft, the sill haling a groove therein which defines a lower track;

(b) attaching an elevator door track to a header;

(c) installing the header supported by a plurality of support members;

(d) lifting an elevator door from the hallway, and not from a moving platform, and suspending the elevator door from the track so that is slides on the door track and slides within the sill groove;

(e) installing a frame, in a bolted or fully welded assembly, comprising a strike jamb having a top portion which when assembled forms a composite strike pocket together with one of the support members, a return jamb having a top portion and positioned parallel to the strike jamb, and a head jamb connected to the strike and return jambs proximate their top portions; and (f) attaching to the header and one of the support members a stationary side panel extending from the finished floor to the header and proximate said support member and return jamb, said panel occupying about one-half or less of the wall opening and being between the front and rear facing planes of the wall.

10. The method of claim 9 wherein said header has an opening formed therein and further comprising adjusting said door through said header opening after the frame is installed.

11. The method of claim 9 wherein said sill occupies about two-thirds of the wall opening and is between the front and rear facing planes of the wall, the method further comprising attaching a stationary side panel having a fireproof rating to the header and one of said support members, said stationary side panel extending from the hallway to the header and proximate said support member.

12. A method of installing an elevator sliding entrance door assembly in a building under construction without using a moving platform, in which the assembly is installed between a hallway and an elevator shaft and which partially closes off the shaft during construction; the assembly being assembled from the hallway and viewed from the hallway, the steps of the method comprising:

(a) installing a sill in the hallway and proximate the shaft, the sill having a groove therein which defines a lower track;

(b) attaching an elevator door track to a header;

(c) installing the header supported by a plurality of support members;

(d) lifting an elevator door from the hallway, and not from a moving platform, and suspending the elevator door from the track so that is slides on the door track and slides within the sill groove; and (e) installing a frame, in a bolted or fully welded assembly, comprising a strike jamb having a top portion which when assembled forms a composite strike pocket together with one of the support members, a return jamb having a top portion and positioned parallel to the strike jamb, and a head jamb connected to the strike and return jambs proximate their top portions.

* * * * *